US006319015B1

(12) United States Patent
Faunce

(10) Patent No.: US 6,319,015 B1
(45) Date of Patent: Nov. 20, 2001

(54) GARMENT ELECTRICAL CONNECTOR

(76) Inventor: Michael J. Faunce, c/o Memory Time/Auto Time 6605 SW. Macadam Blvd., Portland, OR (US) 97201

( * ) Notice: Subject to any disclaimer, the term of this patent is extended or adjusted under 35 U.S.C. 154(b) by 0 days.

(21) Appl. No.: 09/527,795

(22) Filed: Mar. 17, 2000

Related U.S. Application Data

(63) Continuation-in-part of application No. 09/412,247, filed on Oct. 5, 1999, now abandoned, which is a continuation-in-part of application No. 09/378,983, filed on Aug. 23, 1999, now abandoned.

(51) Int. Cl.[7] ..... H01R 11/30
(52) U.S. Cl. ..... 439/37; 24/217; 361/220
(58) Field of Search ..... 439/37, 108, 409; 2/905, 906; 361/220, 886, 887

(56) References Cited

U.S. PATENT DOCUMENTS

| | | | |
|---|---|---|---|
| 1,691,472 | 11/1928 | Graham et al. | 439/37 |
| 2,685,021 | 7/1954 | Duncan | 439/37 |
| 3,783,477 | 1/1974 | Hamilton et al. | 24/213 |
| 3,818,209 | 6/1974 | Roth | 439/37 |
| 3,821,692 | 6/1974 | Barnard | 439/886 |
| 3,975,079 | 8/1976 | Blakesley et al. | 439/887 |
| 4,000,547 | 1/1977 | Eisenpresser | 24/214 |
| 4,099,303 | 7/1978 | Parera | 24/217 R |
| 4,676,561 | 6/1987 | Barrett, II | 439/37 |
| 4,747,783 | 5/1988 | Bellamy et al. | 439/886 |
| 4,751,773 | 6/1988 | Nysten | 24/681 |
| 4,864,619 | 9/1989 | Spates | 381/25 |
| 4,908,943 | 3/1990 | Harel et al. | 439/887 |
| 4,927,366 | 5/1990 | Tommerson et al. | 439/439 |
| 5,003,673 | 4/1991 | Nysten | 24/662 |
| 5,018,044 | 5/1991 | Weiss | 439/37 |
| 5,265,165 | 11/1993 | Rauch | 381/25 |
| 5,303,426 | 4/1994 | Jones | 2/181 |
| 5,329,592 | 7/1994 | Altman | 381/25 |
| 5,438,698 | 8/1995 | Burton et al. | 455/351 |
| 5,573,421 | 11/1996 | Reichle | 439/409 |
| 5,625,903 | 5/1997 | Schultz et al. | 2/209 |

*Primary Examiner*—Renee Luebke
*Assistant Examiner*—Briggitte R. Hammond
(74) *Attorney, Agent, or Firm*—Dellett and Walters

(57) ABSTRACT

A connector for use with fabric, such as when formed into a garment, employs a first connector secured to the fabric and a second mating connector associated with an external device. The connectors, when joined, pass electrical signals such as audio or data signals between the external device and the garment.

10 Claims, 6 Drawing Sheets

GARMENT ELECTRICAL CONNECTOR

CROSS REFERENCE TO RELATED APPLICATION

This application is a continuation-in-part of U.S. patent application Ser. No. 09/412,247, filed Oct. 5, 1999, abandoned, which is a continuation-in-part of U.S. patent application Ser. No. 09/378,983, filed Aug. 23, 1999, abandoned.

BACKGROUND OF THE INVENTION

This invention relates to connectors, and more particularly to an improved electrical connector adapted for use with garments.

With advances in technology, there are now various electronic items that require adherence to or integration with fabric and garments. Examples of these are personal stereos, heart rate monitors, bio-feedback sensors, telephone headsets, data line connections, microprocessors, computerized components, etc. Standard electrical connectors, however, have not adapted well to this type of attachment and use. Connectors attached to the fabric of garments have different, more rigorous requirements than those of standard electrical connectors.

Electrical connectors attached on garments see moisture, in the form of sweat, rain, or snow. They must endure extreme temperatures as they are often used outside for sports such as skiing, hiking, jogging or biking. Such electrical connectors are frequently quickly and unexpectedly uncoupled from various angles as the electrical wires attached to the connector are often inadvertently caught amidst the physical movement of the wearer. Since the garment with the attached connector is in motion, there is often constant strain on the electrical leads that tug at the connector attempting to break its electrical contact. In sporting applications, these connectors often see physical shock.

From an ergonomic perspective, the attachment method must leave the garment so as to be non-irritating to the body of the wearer. The connector must also be aesthetically appealing as it is usually visible upon the outer wear. Since the electrical device may not always be connected to the garment, the connector must have a low profile when not connected with an absence of any exposed sharp edges. Since many of today's fabrics are high tech and very thin, especially in the area of cold weather recreation wear, the connector must also be lightweight so as to allow its mass to be supported by the fabric. These connectors must also be very rugged and be able to withstand numerous couplings. Since most applications require more than one connector, the position of the connectors relative to one another must be maintained even though the fabric is flexible. Since many of the garments relate to sports, they must be frequently sanitized and the connector must be able to withstand washing and drying in a conventional washer and dryer. Additionally, while experiencing the above adverse conditions, the connector must maintain electrical continuity at all times.

Prior art examples of this type of connector have only met with marginal success because most have been attempts at modifying conventional electrical connectors so that they adhere to fabric, rather than adapting a clothing style fastener so that it carries an electrical signal. It would be desirable to have a connector for attaching a garment to an external device for exchange of signals that is capable of meeting all the stringent requirements discussed above.

SUMMARY OF THE INVENTION

In accordance with the invention, an electrical connector adapted for connective use with fabric is provided. The connector includes snap fasteners mounted to a region of a fabric, such as in a garment, and a corresponding interface connector that mates therewith and conveys a signal to or away from the fabric connectors.

Accordingly, it is an object of the present invention to provide an improved electrical connector that can be removably secured to fabric.

It is yet a further object of the present invention to provide an improved electrical connector secured to fabric that is rugged enough to withstand numerous couplings.

It is a further object of the present invention to provide an electrical connector that can be removably secured to fabric and can maintain electrical continuity under conditions of normal motion occurring during recreational or sporting activities.

It is yet another object of the present invention to provide an electrical connector that can be removably secured to fabric and will withstand machine washing.

It is still another object of the present invention to provide an aesthetically appealing, lightweight, electrical connector for fabric that is shock resistant, soft, and has a low profile above the fabric when not coupled.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The connector according to the present invention comprises a two part releasable electrical connector wherein one part is attached onto fabric, which may comprise a garment.

Figure 1:
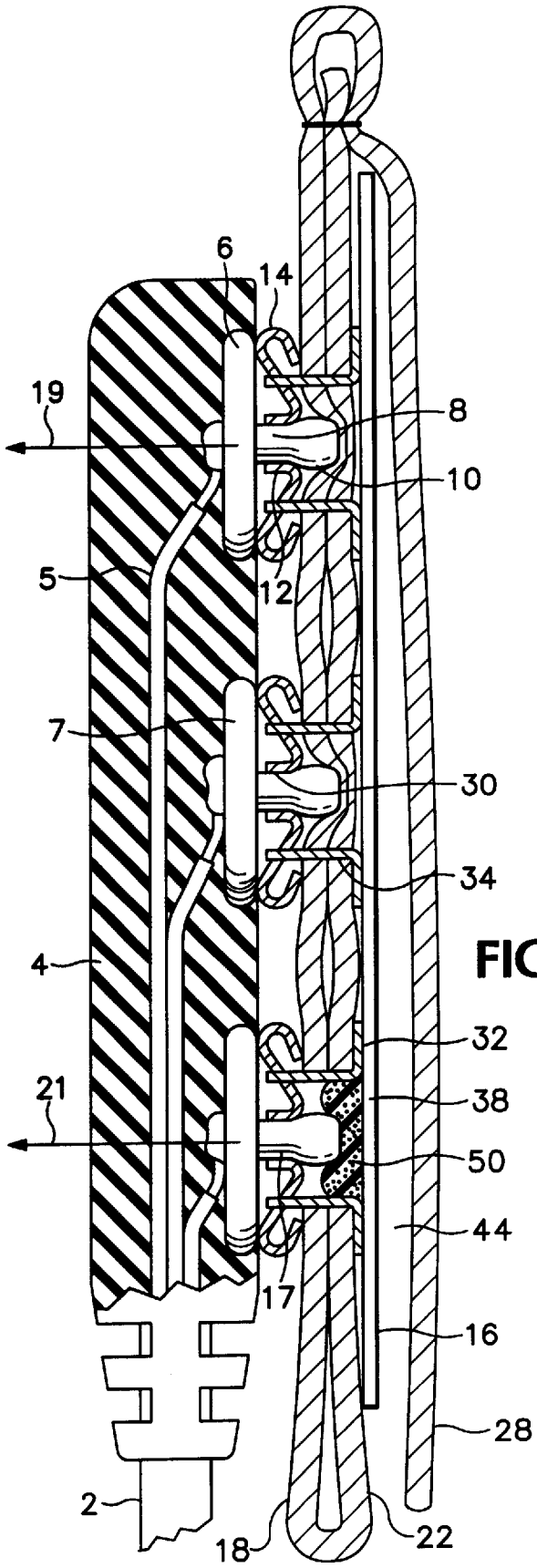
FIG. 1 is a cross sectional view of a coupled electrical connector according to a first style, showing the method of attachment between the female snap and the fabric of a garment.

Referring to FIG. 1, a cross sectional view of one embodiment of a coupled electrical connector, electrical lead wires 5 are combined in a single outer sheath multi-conductor cable 2 leading to an external device, and are imbedded in rigid housing 4. The ends of the lead wires 5 are attached to inner faces 7 of respective male snaps 6, which are suitably mounted to housing 4, wherein the inner faces of the snaps are contained within the interior of housing 4. A post 8 extends normally away from the housing from the approximate center of each male snap 6, the post 8 defining a taper portion 17 that transitions into a bulbous portion 10 at the end of the post distal from the housing 4.

In this embodiment, three male snaps 6 are molded into housing 4 such that the faces 7 without post 8 (also visible in phantom in FIG. 2) are embedded into housing 4. Within housing 4, conducting wires are connected onto the imbedded faces 7 of male snaps 6. These wires exit housing 4 contained in a single sheath, insulated from each other, forming multi-conductor cable 2. Multi-conductor cable 2 ends in a multiple contact connector plug (not illustrated) that is capable of connecting three conductors in one mechanical coupling as is well known in the field of electronics.

Corresponding to the male snaps are female snaps 14, each having deformable sockets 12 therein, defining orifices 30 (FIG. 2) formed centrally thereon. Ring connector pins 34 extend normally from a circular ring connector 32, piercing a fabric outer layer 18 and a fabric middle layer 22 and frictionally attaching to female snap 14. Each ring connector 32 is affixed physically and electrically to corresponding lands 38 on a face of circuit board 16 which resides in a fabric pocket 44 defined between the fabric middle layer 22 and a fabric inner layer 28. Circuit board 16 is a lightweight non-conductive substrate sheet having two planar faces and typically made of a phenolic material. Lands 38 are electrically conductive areas on the planar faces of circuit board 16 that traverse the thickness of circuit board 16 thereby allowing electrical current to be transmitted between the faces. Adjacent lands 38 are electrically isolated from each other by the insulating properties of phenolic circuit board 16.

Housing 4 is preferably made of a flexible plastic or other suitable polymer so as to preserve the relative position of male snaps 6 while allowing for individual alignment with female snaps 14 upon coupling. However, a more rigid plastic may also be used in alternative embodiments. The relative position of female snaps is maintained by ring connectors 32 which are affixed to lands 38 on one face of a singular circuit board 16. Circuit board 16 is sized so as to be non-obtrusive within the garment. Where different positional alignment of female snaps 14 is desired, a different size and shape circuit board may be utilized.

In the embodiment of FIG. 1, the two portions of the connector, comprising the housing with the male snaps and the fabric layers with the circuit board and female snaps, are attached together. Each female snap 14 releasably engages a corresponding post 8 when the exposed faces of the male snaps and female snaps 14 are aligned and pressed together. This type of engagement brings deformable sockets 12 and corresponding male snap posts 8 into contact. An individual deformable socket 12 has radial notches positioned substantially regularly around the perimeter (not illustrated) that allow socket 12 to expand the diameter of orifice 30 over the bulbous portion 10 of the mating male snap 6, and then contract the diameter of orifice 30 when encircling the smaller diameter region of post 8, thereby releasably engaging male snap 6. Taper 7 transitions the bulbous portion 10 into the smaller diameter region of post 8, thereby allowing orifice 30 of socket 12 to contract and pull male snap 6 and female snap 14 into close contact, providing adequate surface area to transmit electrical current therebetween.

Referring still to FIG. 1, it will be observed that connector pins 34 pierce fabric outer layer 18 and fabric middle layer 22, and non-releasably frictionally engage the perimeter of female snap 14 thereby attaching female snap 14 onto garment outer layer 18. In this fashion, two fabric layers are sandwiched between ring connector 32 and female snap 14. Depending on the particular fabric, the nap or pile of the fabric will be such as to impart an upward force indicated by arrow 19 upon post 8 which urges portion 10 of post 8 of male snap 6 against socket 12 of female snap 14, thus ensuring a firm and continuous contact between male snap 6 and female snap 14 for a relatively noise free electrical connection. If the fabrics used do not possess a spongy, compressible yet resilient nap or pile characteristic that allows the fabric to cause the upward urging, then an elastomeric member 50 (shown in the bottommost connector snap in FIG. 1) is suitably positioned within the ring connector, so as to exert a pressure in the direction of arrow 21 to urge the post against the socket 12 of female snap 14. The elastomeric member may suitably comprise an elastic membrane sheet placed along the extent of the region where the female snaps are mounted, or a plug that fits within the interior of ring connector 32. In other embodiments, member 50 may be replaced by a plug of fabric, foam, rubber or any suitably compressible material with sufficient elasticity to provide the desired upward urging to the male connector portion.

Female snap 14, male snap 6 and ring connector 32 are plated with electrically conducting metal so as to allow good electrical contact between these components. Preferably, this plating is gold because the superior conductive properties of gold are desirable to provide a high quality, low resistance electrical contact.

In FIG. 1, the layers of fabric 18, 22 and 28 are simply folded over portions of a continuous fabric sheet. This is not a requirement, but is merely a result of the particular configuration illustrated. The various fabric layers can be separate layers, and may comprise different types of fabrics, for example. In the configuration of FIG. 1, because of the relative rigidity provided by the double folds in the fabric, the relatively light mass of female snap 14 is supported by the fabric.

The circuit board 16 extends some distance beyond the upper and lower extent of the placement of snaps. The additional portion of the board extending beyond the ends of the peripheral snaps provides a backing effect, to minimize the chance of the female portions of the snaps from being pulled away from the fabric. The board also suitably can comprise lateral extensions to provide stability against side to side rocking, if desired.

Figure 2:
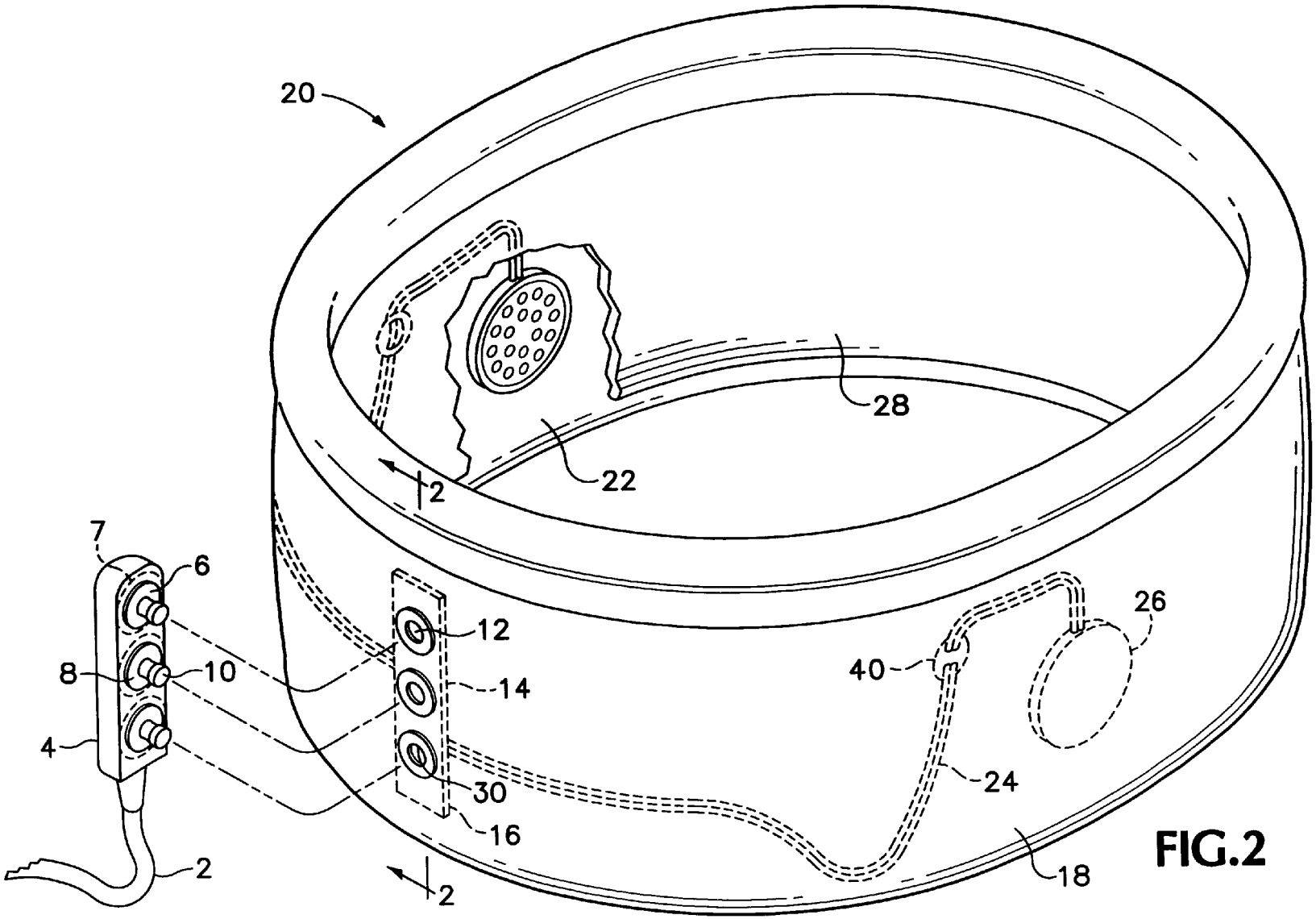
FIG. 2 is a perspective view of the electrical connector of FIG. 1 as embodied in an audio head garment, with the two portions of the connector disconnected from each other.

Referring now to FIG. 2, a perspective view of the embodiment of the electrical connector as employed in an exemplary use with an audio head garment, with the two portions of the connector disconnected from each other, the spatial relationship between the components can be better appreciated. Female snaps 14 (three being employed in the illustrated embodiment) reside on outer fold 18 of a headband 20 and are mounted to the planar circuit board 16, wherein the circuit board is mounted within head band 20 (the headband being constructed by folding a fabric strip into the three layers 18, 22 and 28). Circuit board 16 receives channel lead cables 24 that are interwoven through slideable wire stops 40 and are connected to left and right speakers 26 which reside between middle layer 22 and inner layer 28 of headband 20. A left and right channel speaker system is thereby defined.

By moving the housing 4 towards the female connectors as illustrated by the two dot chain lines, posts 8 are introduced into the sockets 12, to releasably interconnect the posts and sockets. An electrical connection between the conductors of cable 2 and the internal wiring of the headband is thereby accomplished.

Figure 3:
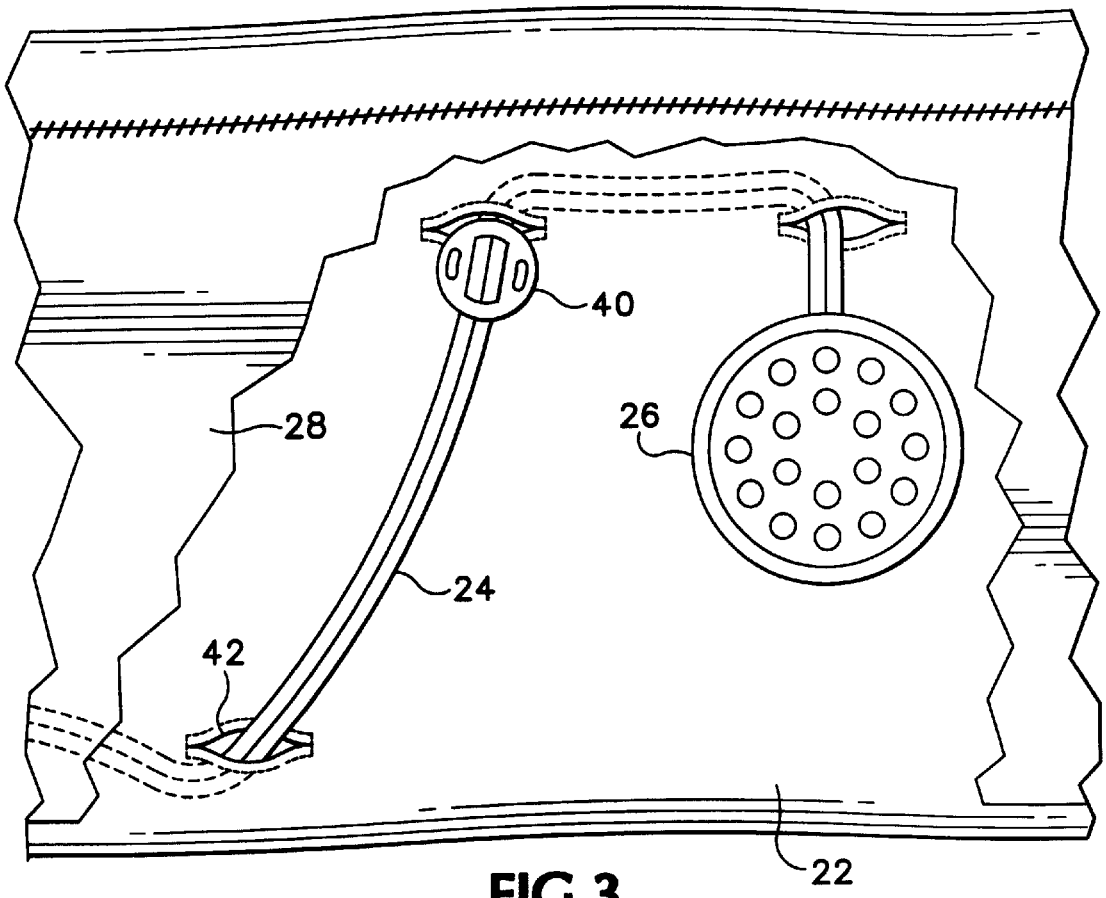
FIG. 3 is a partial, cutaway view of the audio head garment of FIG. 2 in the region of the speaker.

Referring to FIG. 3, a cutaway view of the audio head garment of FIG. 2 in the region of one of the speakers, the method of supporting the speaker is visible. Slideable wire stops 40 are mounted on channel lead 24, which is woven through a plurality of sewn buttonholes 42 formed through middle layer 22. The wire stops are larger in diameter than the opening of unstretched buttonholes 42. Speaker 26 is attached to channel lead 24.

Referring to FIGS. 1 and 2 together, it can be seen that this embodiment of the electrical connector is of a rugged snap together design that mechanically couples male snap 6 to female snap 14 thereby allowing electrical continuity. In use, female snap 14, rather than male snap 6, is permanently affixed to the fabric of the garment. This is because female snap 14 has a lower profile than male snap 6 so that when the garment is worn without the two snaps connected, the low profile of the female connector reduces the likelihood of the connector interfering with normal use of the garment, or of causing physical harm to objects or body parts that the garment brushes against.

The configuration having the male connectors on the housing 4 leaves posts 8 protruding from one face of housing 4 and susceptible to shorting by contact with a conducting surface. However, because the intended applications of this connector transfer low strength signals, damage will not occur if shorting occurs.

Upon removal of male snap 6 from the garment, all the elements of the electrical connector remaining on the fabric are waterproof and can withstand machine washing of the fabric. Speakers 26 are of a miniaturized electroacoustical transducer configuration employing a cone made of polypropylene or another suitably waterproof durable polymer. Since the speaker is waterproof, it also can be washed along with the headband.

In operation, once the multiple contact connector jack is inserted into the mating receptacle connector of a personal stereo system, the electrical signal is carried to and from the garment.

Figure 4:
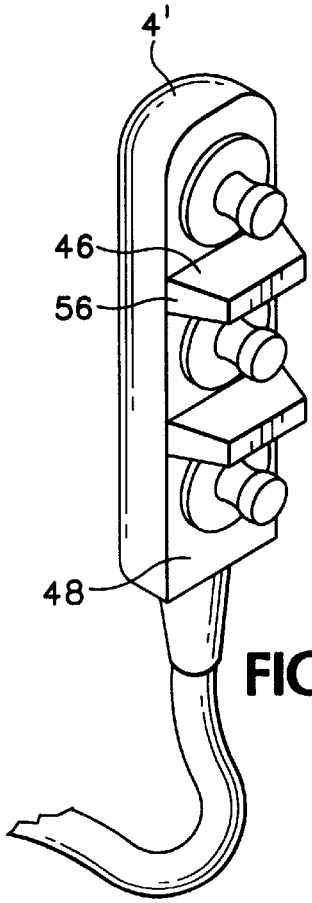
FIG. 4 is a perspective view of the preferred embodiment of the first style electrical connector housing.

Referring to FIG. 4, a perspective view of the preferred embodiment of the electrical connector housing, a housing 4' has plural male snaps 6 mounted thereon in a manner corresponding to the embodiment of FIG. 1. Plural force bars 46 lie between adjacent male snaps 6, protruding normal from planar face 48 of housing 4' and are orientated perpendicularly to the longitudinal axis of housing 4'. Force bars 46 are suitably made from the same material as housing 4' and the edges of force bars 46 have a slight chamfer 56.

Figure 5:
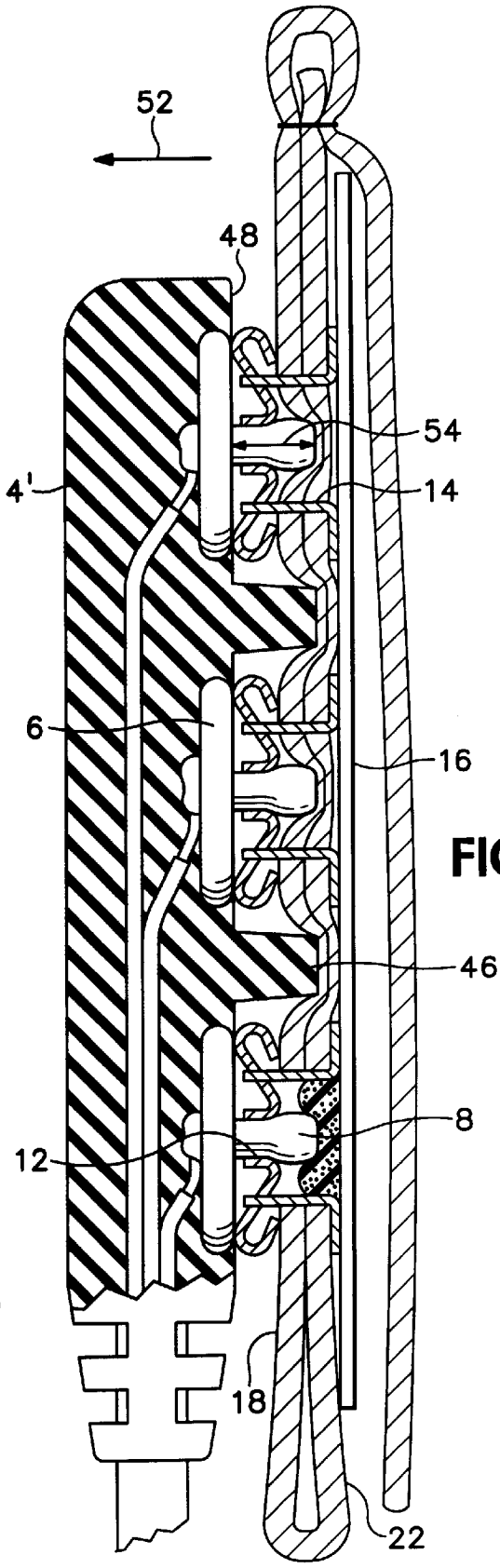
FIG. 5 is a cross-sectional view of a coupled electrical connector according to the preferred embodiment of the first style.

Referring to FIG. 5, a cross-sectional view of a coupled electrical connector showing the preferred embodiment of the electrical connector housing, electrical continuity force bars 46 relative to the resilient, spongy, and compressible fabric can be seen. The preferred embodiment electrical connector differs from the FIG. 1 embodiment electrical connector by the inclusion of force bars 46. Force bars 46 contact fabric outer layer 18 so as to compress fabric outer layer 18 and fabric middle layer 22 against the front face of circuit board 16. The height that force bars 46 protrude above planar face 48 is approximately equivalent to the height post 8 protrudes above housing planar face 46 as indicated by dimension line 54.

Referring now to FIG. 4 and FIG. 5, the operation of electrical continuity force bars 46 in the preferred embodiment of the electrical connector can be explained. When housing 4' with male snaps 6 and the fabric layers with circuit board 16 and female snaps 14 are aligned and pressed together, female snap 14 releasably engages corresponding post 8. Similar to the releasable engagement discussed above with respect to the embodiment of FIG. 1, orifice 30 expands its diameter over the bulbous portion 10 of post 8 of mating male snap 6, and then contracts its diameter thereby encircling the smaller diameter taper portion 17 of post 8. As orifice 30 contracts, bulbous portion 10 of post 8 slides deeper into socket 12 of female snap 14 because of the design of taper portion 17. Force bars 46 contact outer fabric layer 18 and compress outer fabric layer 18 and middle fabric layer 22 against the planar face of circuit board 16. Since the fabric is of a compressibly resilient nature, the compressed fabric generates a counter force against force bars 46 in the direction indicated by arrow 52 which attempts to push male snaps 6 away from or out of female snaps 14. This forces post 8 to slide partially back out of deformable socket 12 causing orifice 30 to expand its diameter slightly to accommodate the increasing diameter of taper portion 17 ensuring that there is good snug contact between the two portions of the connector and preventing male snap 6 from moving relative to female snap 14. Force bars 46 thus both enhance and maintain the electrical continuity of the electrical connector. Force bars 46 also act as guards around posts 8 to prevent them from getting caught on another object and pulled away from housing 4'.

While the embodiment set forth hereinabove provides three distinct connections, in some applications, it may be desirable to have more than three connection, if, for example, multiple signal lines are to be conveyed across the connector. Therefore, an alternate embodiment of the connector is provided to meet this need.

Figure 6:
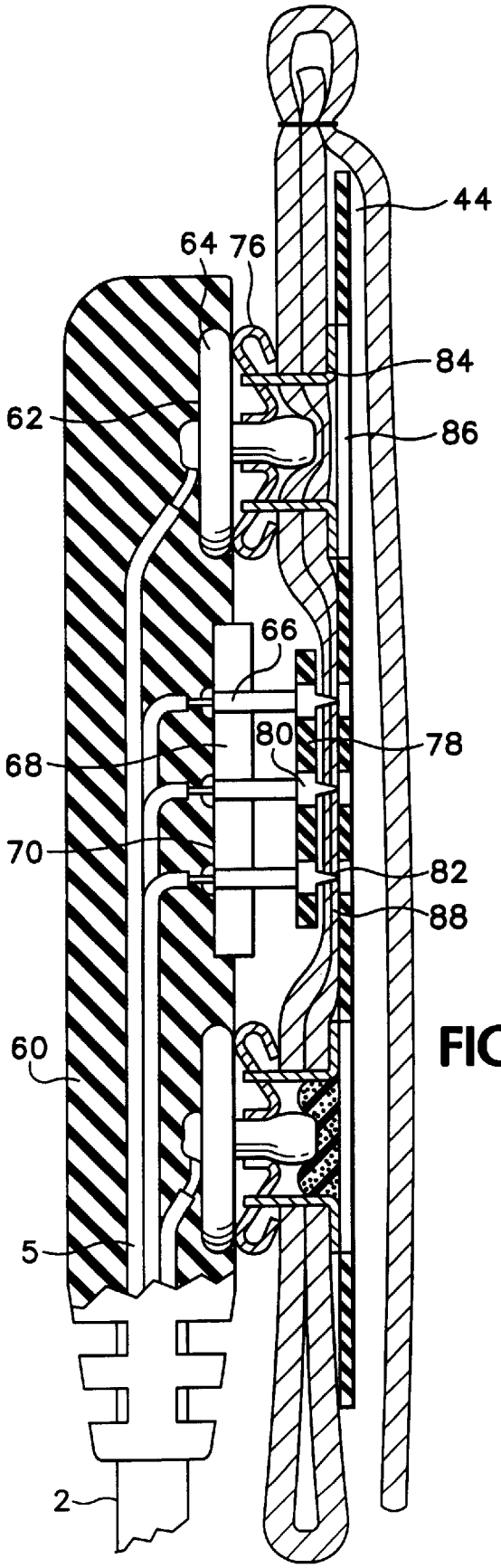
FIG. 6 is a cross sectional view of an second style embodiment of a coupled electrical connector according to the invention.
Figure 7:
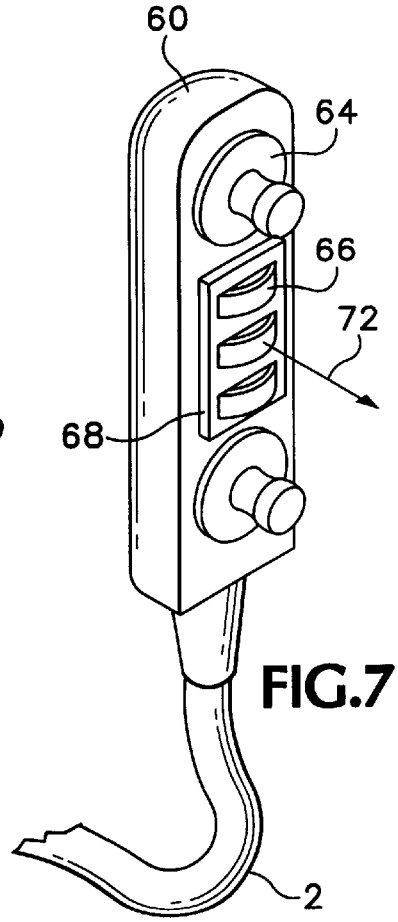
FIG. 7 is a perspective view of the second style embodiment of the electrical connector housing according to the invention.
Figure 8:
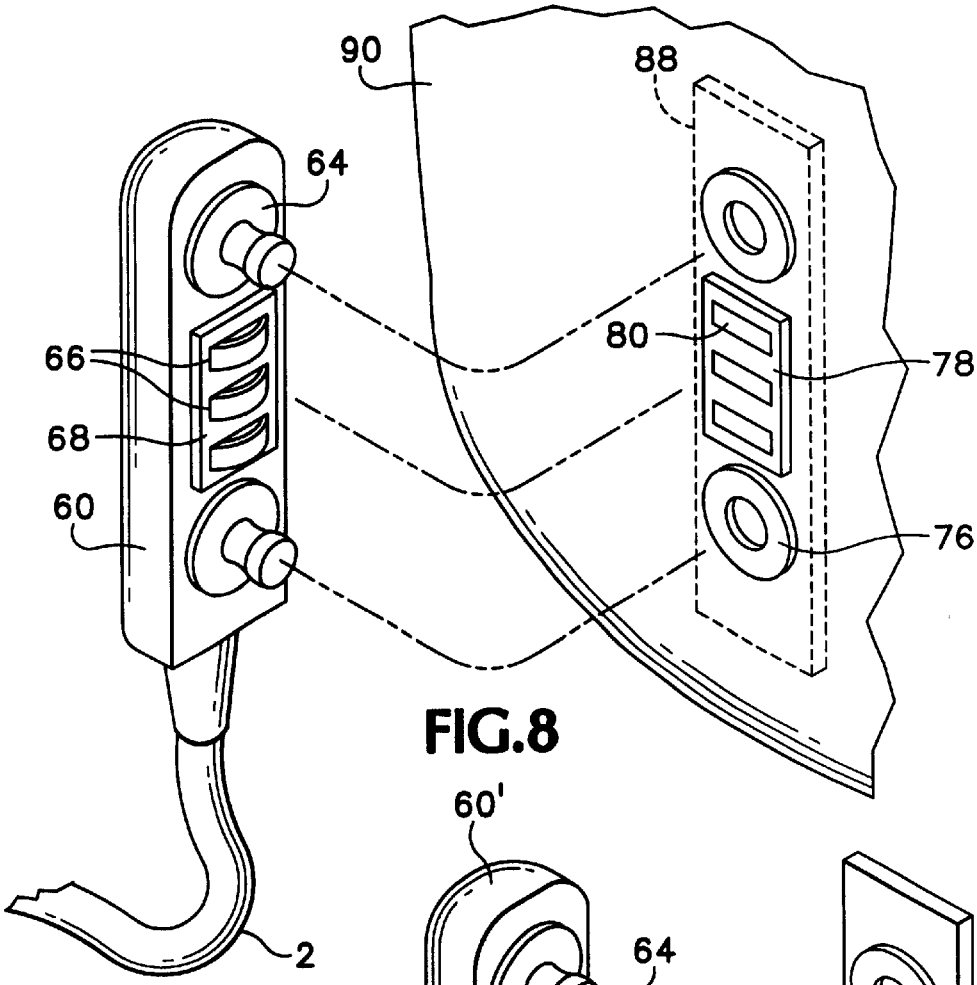
FIG. 8 is a perspective view of the embodiment of an the electrical connector of FIG. 6 as attached to a fabric, with the two portions of the connector disconnected from each other.

Referring to FIGS. 6–8, the alternative connector employs a male contact housing 60 having first and second male snap members 64 positioned on one face of the housing, at distal ends thereof. Centrally between the two snap members is an electrically insulative spring contact housing block 68 having plural spring contact members 66 thereon, oriented away from the housing in the same general direction as the male snap members. In the illustrated embodiment, the spring contact block carries three separate contact members thereon. Any number may be employed, but suitably between three and five are preferred. The specific number of such contact members depends on the number of distinct signal lines required by the application. The individual spring contact members are biased to be urged outwardly in the direction of arrow 72 of FIG. 7.

Corresponding to the male contact housing 60 is female contact circuit board 88 (illustrated in phantom in FIG. 8). Board 88 carries female snap members 76 thereon, positioned at distal ends of the board so as to correspond to the position of the two male snaps 64. Between the two female snap members, a contact bar plate 78 is provided, carrying plural contact pads 80 thereon. Suitably, the number of contact pads 80 corresponds to the number of spring contact members 66, and the pads are positioned in spaced relation to one another so as to align with the spring contact members.

As in the previously described embodiment, plural electrical lead wires 5 are combined in a single outer sheath multi-conductor cable 2 leading to an external device, and are imbedded in rigid housing 60. The lead wires 5 are attached to inner faces 62 of either respective male snaps 64, or to one or more of the spring contact members 66. Both male snaps 64 and spring contact housing 68 are suitably mounted by being partially imbedded in housing 60. The configuration of male snap members 64 and female snap members 76 correspond to male snaps 6 and female snaps 12 of FIGS. 1–5.

Spring contact members 66 comprise resilient, compressible U-shaped conductors mounted within housing 68. A contact lead is provided at the back of the housing 68 for each spring contact member, to enable connection to lead wires 5. On the front face of the housing 68 the spring contact members 66 resiliently protrude beyond the plane of the face.

Referring to FIG. 6, in a manner corresponding to the configuration of FIGS. 1–5, ring connector pins 84 pierce layers of fabric and physically and electrically attach female snap 76 to corresponding electrically conductive lands 86 on a face of circuit board 88. The circuit board may reside in a fabric pocket 44. Contact bar plate 78 carries contact bars 80 in the spatial arrangement that corresponds to that of spring contacts 66 of spring contact housing block 68. Contact bars 80 have pins 82 which pierce the fabric and connect to electrically conductive lands 86 of the circuit board. Pins 82 and Ring connector pins 84 maintain the relative position of female snaps 76 and spring contact plate 78.

Circuit board 88 is a lightweight non-conductive substrate sheet having two planar faces, and is typically made of a phenolic material. Lands 86 of various shapes and sizes traverse the thickness of circuit board 88 thereby allowing electrical current to be transmitted between the faces. Adjacent lands 86 are electrically isolated from each other by the insulating properties of phenolic circuit board 88.

Housing 60 is preferably made of a flexible plastic or other suitable polymer so as to preserve the relative position of the male snaps and spring contact plate while allowing for individual alignment with their counterparts.

Referring now to FIG. 8, a perspective view of the alternate embodiment electrical connector, with the two portions disconnected from each other, the spatial relationship between the components can be seen. Circuit board 88 resides behind fabric 90 and is illustrated in phantom. In use, to make a connection, the housing 60 is brought towards the circuit board 88, and male snap members 64 are engaged with female snap members 76. The positioning and configuration of the block 68 and 78 results in ones of spring contact members 66 engaging corresponding ones of contact bars 80, providing electrical connections therebetween. Accordingly plural distinct signals may be carried across the conductors.

The coupling between the female snaps and male snaps provide the alignment and force necessary to bring and maintain each of three spring contact members 66 into position with the associated contact bars 80 so as to permit the transmission of electrical current therebetween. The spring bias of contact members 66 ensures consistent electrical connections, even with significant movement of the connections. The contacts are all suitably plated, with gold or some other metal to provide low resistance connections and to reduce the likelihood of corrosion.

Figure 9:
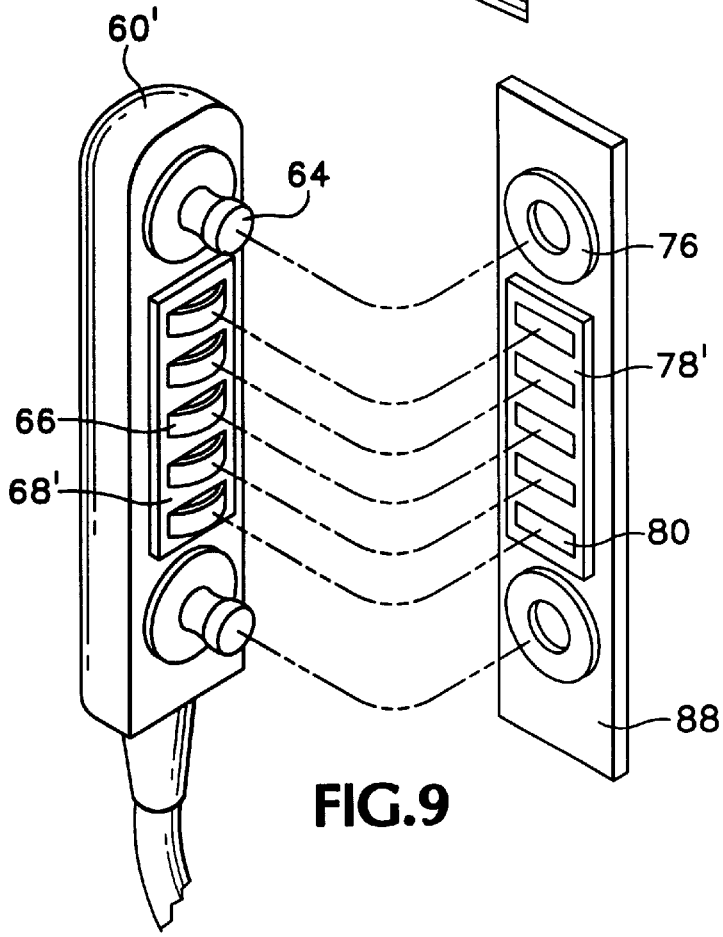
FIG. 9 is a perspective view of embodiment of the second style electrical connector of the invention providing 7 signal connections.

While this illustrated embodiment employs a spring contact housing with three separate spring contact members, it is possible to have spring contact housings with differing numbers of spring contacts and a correspondingly configured contact bar plate. FIG. 9 illustrates a preferred alternative connector having seven total signal lines, the two snap members 64/76, and a central connection block 68' having five distinct spring connection members 66 thereon. Five corresponding contact bars 80 are provided on the circuit board 88. The one-to-one correspondence between the snap members and spring contact members/contact bars is illustrated by dashed lines. While it is preferred to employ the snap member connections as signal lines (for example, one being employed as ground), it is possible to use the snap members only as position alignment members if preferred, foregoing any electrical connection thereto.

Although the use of the connector of the first embodiment according to the invention is in conjunction with a headband garment, with either embodiment of the connector, numerous different articles of clothing or fabrics may be substituted for the headband. For example other headwear such as hats, ski masks, hoods, or scarves may have the electrical connector attached thereto. Other articles of clothing may also be used, such as shirts, coats, pants, gloves, shoes, boots, etc. Further, while the illustrated use is to transmit audio signals from a personal audio device to speakers in a headband, the connector is adapted for other uses, such as data transmission, control signal exchange, etc. The garment may have any type of transducer or sensor thereon and may provide either data or signal to transmit from the garment side, or data or signal to be received at the garment side, or both. A microprocessor may be suitably included within the garment, and sensors may be attached to the body of the wearer of the garment. In such case, the sensors may suitably be attached to the garment on the inside thereof, and the garment connector according to the invention is then employed to enable releasable connection with external devices. A wearable computer device is also suitably provided, with the connector providing I/O from the computer to any external device. Positional sensors or body temperature sensors may be included in the garment. The signals transferred through the connector may be video, audio, data, etc.

A security garment for use with security/correctional applications is also suitably provided, wherein the wearer's location is monitored and violations or changes are reported if the wearer moves beyond a defined location or area.

Alternate embodiments of the snap connector include corresponding designed electrically conductive, lightweight clothing fasteners. Also, more or fewer snaps may be imbedded in the housing or on the circuit board, for multiple channel communications. Display panels and keyboards may be interfaced to the electrical connector with the appropriate microprocessor interface. The electrical connector may be pressed onto the desired garments by specialized tooling or the electrical connector may be attached to a fabric at the factory and then sewn into the appropriate fabric or garment by the consumer.

Additionally, the snap connector and other suitable fastener style connectors may be plated with metals other than gold, such as platinum, silver, copper or steel for electrical conductivity purposes. Still further, while the illustrated connector elements are made of metals, other materials are suitable, so long as they have the desired electrical conductivity properties for the application in which they are used. In other alternate embodiments, the circuit board may be made with a broader planar construction to add stability to the positioning of the female connectors. The preferred embodiment employs female connectors on the garment side, but the male and female connectors may be employed on either side of the connection, and may be mixed, to, as an example, enforce proper connection orientation.

Therefore, a connector suitable for garments, fabric, or other substrates has been shown.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A garment electrical connector comprising:

a support member carrying first connector portions thereon and adapted for exchanging signals with a device;

second connector portions mounted to a garment, said second connector portions adapted to electrically mate with said first connector portions, for carrying signals to and/or from said external device and to and/or from said garment, wherein said support member comprises an elongate bar with at least one face having force member projections thereon that are normal to said face and reside between adjacent first connector portions.

2. A garment electrical connector according to claim 1 wherein said first connector portion and said second connector portion together comprise snap connectors adapted for releasably engaging with one another.

3. A garment electrical connector according to claim 2 wherein said snap connectors comprise gold connectors.

4. A garment electrical connector according to claim 3 wherein said garment has a first side and a second side wherein said second connector is mounted on the first side of said garment by non-releasable attachment to a mounting member which is mounted on said second side of said garment,and wherein said garment is made of cloth that is compressible and resilient to ensure contact between said first connector portion and said second connector portion.

5. A garment electrical connector according to claim 4 wherein said mounting member is non-releasably attached to a planar electrical distribution substrate.

6. A garment electrical connector according to claim 5 wherein said mounting member and said planar electrical distribution substrate are supported between layers of fabric.

7. A garment electrical connector according to claim 6 wherein said first connector, said second connector and said mounting member are plated with an electrically conductive material.

8. A garment electrical connector according to claim 7 wherein said electrically conductive material is gold.

9. A garment electrical connector according to claim 1 wherein one of said first and second connector portions comprises plural biased connection members and the other of said first and second connector portions comprises corresponding plural connection pads for receiving said plural biased connection members thereagainst.

10. A garment electrical connector according to claim 9 wherein said first and second connector portions further comprise mating snap members.

* * * * *